US011029025B2

(12) United States Patent
Sano et al.

(10) Patent No.: US 11,029,025 B2
(45) Date of Patent: Jun. 8, 2021

(54) COMBUSTIBLE WASTE INJECTION DEVICE AND METHOD FOR OPERATING THE SAME

(71) Applicant: Taiheiyo Cement Corporation, Tokyo (JP)

(72) Inventors: Yuya Sano, Sakura (JP); Kouichi Naitou, Tokyo (JP); Hidenori Tsukidate, Sakura (JP); Hideyuki Sugaya, Sakura (JP)

(73) Assignee: Taiheiyo Cement Corporation, Tokyo (JP)

( * ) Notice: Subject to any disclaimer, the term of this patent is extended or adjusted under 35 U.S.C. 154(b) by 0 days.

(21) Appl. No.: 16/976,724

(22) PCT Filed: Aug. 14, 2019

(86) PCT No.: PCT/JP2019/031932
§ 371 (c)(1),
(2) Date: Aug. 28, 2020

(87) PCT Pub. No.: WO2021/029032
PCT Pub. Date: Feb. 18, 2021

(65) Prior Publication Data
US 2021/0054996 A1 Feb. 25, 2021

(51) Int. Cl.
*F23G 5/20* (2006.01)
*F27B 7/34* (2006.01)
*F23G 5/44* (2006.01)

(52) U.S. Cl.
CPC ..... *F23G 5/20* (2013.01); *F23G 5/444* (2013.01); *F27B 7/34* (2013.01)

(58) Field of Classification Search
CPC ..... F23G 5/20
See application file for complete search history.

(56) References Cited

U.S. PATENT DOCUMENTS 6,077,072 A 6/2000 Marin et al.
6,315,551 B1 * 11/2001 Salzsieder ..... F23D 14/24 239/400
(Continued)

FOREIGN PATENT DOCUMENTS

CN 104011465 A 8/2014
JP H08-283052 A 10/1996
(Continued)

OTHER PUBLICATIONS

International Search Report for International Application No. PCT/JP2019/031932, dated Sep. 17, 2019 in 11 pages.
(Continued)

*Primary Examiner* — Nathaniel Herzfeld
(74) *Attorney, Agent, or Firm* — Knobbe, Martens, Olson & Bear, LLP

(57) ABSTRACT

There is provided a combustible waste injection device and a method for operating the same which can suppress a landing combustion of a combustible waste and suppress excessive change of a flame state from a cement kiln burner even if a rate of using the combustible waste fluctuates. A combustible waste injection device according to the present invention has a combustible waste flow channel which is arranged in an inner side of the air flow channel in an innermost shell, is installed in parallel to an axial direction of the cement kiln burner device and is provided for flow feeding a combustible waste flow, and the combustible waste flow channel has an inclined surface having a rising slope toward the injection port near the injection port in such a manner that a flow channel width in a vertical direction is narrowed toward the injection port.

11 Claims, 8 Drawing Sheets

(56) References Cited

U.S. PATENT DOCUMENTS

| | | | | |
|---|---|---|---|---|
| 8,393,893 | B2 * | 3/2013 | Schroder | F23G 5/20 431/182 |
| 2010/0064986 | A1 | 3/2010 | Kiyama et al. | |
| 2014/0356794 | A1 * | 12/2014 | Hagstrom | F23D 1/005 431/12 |
| 2016/0008830 | A1 * | 1/2016 | Yamamoto | B05B 7/205 239/79 |

FOREIGN PATENT DOCUMENTS

| | | | |
|---|---|---|---|
| JP | 2000-105080 | A | 4/2000 |
| JP | 2001-114539 | A | 4/2001 |
| JP | 2003-090522 | A | 3/2003 |
| JP | 2007-084434 | A | 4/2007 |
| JP | 2010-230196 | A | 10/2010 |
| JP | 2011-207682 | A | 10/2011 |
| JP | 2012-202618 | A | 10/2012 |
| JP | 2015-190731 | A | 11/2015 |
| JP | 2015-535922 | A | 12/2015 |
| JP | 2017-122565 | A | 7/2017 |
| WO | 2008/038426 | A1 | 4/2008 |
| WO | 2013/8055286 | A1 | 4/2013 |
| WO | 2014/056804 | A1 | 4/2014 |

OTHER PUBLICATIONS

Japanese Office Action for Japanese Patent Application No. 2019-561197, dated Dec. 19, 2019 in 10 pages including English Translation.

Taiwanese Office Action for Taiwanese Patent Application No. 109104741, dated Sep. 14, 2020 in 15 pages including English translation.

Chinese Office Action for Chinese Patent Application No. 201980016048.2, dated Mar. 2, 2021 in 17 pages including English translation.

* cited by examiner

COMBUSTIBLE WASTE INJECTION DEVICE AND METHOD FOR OPERATING THE SAME

CROSS-REFERENCE TO RELATED APPLICATIONS

This application is the U.S. National Phase under 35. U.S.C. § 371 of International Application PCT/JP2019/031932, filed Aug. 14, 2019. The disclosures of the above-described applications are hereby incorporated by reference in their entirety.

TECHNICAL FIELD

The present invention relates to a combustible waste injection device which is attached to a cement kiln burner, and a method for operating the same.

BACKGROUND ART

Combustible wastes such as waste plastics, wood chips, and automobile shredder residues (ASR) have heat quantities enough to be used as calcination fuels. Therefore, an effective utilization of the combustible wastes has been promoted for the supplemental fuels of the pulverized coals which are the main fuels, in a rotary kiln for use in cement clinker calcination. Hereinafter, such rotary kiln for use in cement clinker calcination will be referred to as "cement kiln".

Conventionally, in a fuel recycling of the combustible wastes in the cement kiln, utilization in a calcining furnace installed in a kiln tail portion has been promoted, the kiln tail portion less affecting a quality of the cement clinker. However, since a used amount of the combustible wastes in the calcining furnace has neared saturation, a technique of utilizing in a main burner which is installed in a kiln front portion has been developed.

Here, in the case where the combustible waste is utilized as a supplemental fuel in a main burner of the cement kiln (hereinafter, referred to as "cement kiln burner"), there may occur a phenomenon that the combustion is kept even when the combustible waste ejected from the cement kiln burner lands on the cement clinker within the cement kiln (hereinafter, referred to as "landing combustion"). In the case where such landing combustion occurs, the cement clinker around the occurring landing combustion of the combustible waste is reduction fired, thereby generating whitening of the cement clinker and abnormality in the cement clinker generating reaction.

In order to prevent the landing combustion of the combustible waste ejected from the cement kiln burner, there are several possible ways. One of the ways is to maintain a floating state of the combustible waste within the cement kiln for a long period of time and complete the combustion of the combustible waste in the floating state. The other of the ways is to form a preferable combustion environment of the combustible waste and accelerate a combustion velocity of the combustible waste. Further the other way is to make the combustible waste land on a far side (a kiln tail side) within the cement kiln and complete the combustion of the combustible waste before a clinker raw material reaches a main reaction area of the cement clinker generation reaction.

For example, the following Patent Document 1 discloses a combustible waste input structure constructed by a plurality of combustible waste burners each rotatably supporting an end portion of the rotary kiln and having a protruding amount between 200 and 500 mm from an end wall of a kiln front portion, as a technique for reducing an energy consumption for making the combustible waste land on the far side (the kiln tail side) within the cement kiln. Further, the following Patent Document 2 discloses a cement producing rotary kiln provided with an auxiliary burner which injects the combustible waste to a main fuel burner by an upward injecting angle on an outer periphery surface of the main fuel burner and at a vertically upper position from the main fuel burner, as a technique for more efficiently burning the combustible waste while avoiding occurrence of an adverse effect caused by the injection of the combustible waste.

PRIOR ART DOCUMENT

Patent Documents

Patent Document 1: JP-A-2003-90522
Patent Document 2: JP-A-2011-207682

SUMMARY OF THE INVENTION

Problems to be Solved by the Invention

In general, a rate between a used amount of a pulverized coal corresponding to a main fuel in the cement kiln burner and a used amount of the combustible waste corresponding to the supplemental fuel may fluctuate due to an availability and a property of the fuels. In order to prevent a quality of the cement clinker from changing even if the fluctuation of the fuel compositions occurs, there is demanded a technique of stabilizing a flame state from the cement kiln burner. However, the methods in Patent Documents 1 and 2 include a problem that the flame state from the cement kiln burner widely fluctuates due to the amount of the combustible waste injected into the cement kiln and the injecting angle.

The present invention is made by taking the above problem into consideration and an object of the present invention is to provide a combustible waste injection device and a method for operating the same which can suppress a landing combustion of a combustible waste and suppress excessive change of a flame state from a cement kiln burner even if a rate of using the combustible waste fluctuates, in the case where the combustible waste is used as a supplemental fuel for producing a cement clinker.

Means for Solving the Problems

The inventors of the present invention have earnestly made a study of the problem mentioned above and have found that the problem mentioned above can be solved by the following combustible waste injection device. The combustible waste injection device is attached to a cement kiln burner device and has an injection port arranged near a center portion of the cement kiln burner device, in which the combustible waste injection device is provided with an inclined surface having a rising slope toward the injection port in a vertically lower side (bottom portion side) within a conduit (hereinafter, referred to as "combustible waste flow channel") for the combustible waste near the injection port.

More specifically, the present invention is a combustible waste injection device which can be attached to a cement kiln burner device having at least one air flow channel in an inner side of a powdered-solid-fuel flow channel, the combustible waste injection device including:

a combustible waste flow channel which is arranged in an inner side of the air flow channel in an innermost shell, is installed in parallel to an axial direction of the cement kiln burner device and is provided for flow feeding a combustible waste flow, and the combustible waste flow channel has an inclined surface having a rising slope toward the injection port near the injection port in such a manner that a flow channel width in a vertical direction is narrowed toward the injection port. In the following description, "inclined surface having a rising slope toward the injection port" may be called as "upward slope". Further, "injection port" corresponds to a cement kiln side end portion in the cement kiln burner device.

The term "combustible waste" in the present description indicates a calcination fuel serving as a supplemental fuel constituted by a general waste and an industrial waste mainly based on an organic material such as waste plastics, wood chips, ASR, meat-and-bone meals or biomasses and having a combustibility, as mentioned above, which is supposed to be utilized as a fuel for a burner together with the powdered-solid-fuel (main fuel). More specifically, a particle size of the combustible waste is 30 mm or less. Further, "biomasses" are organic resources which can be utilized as a fuel except fossil fuels and are derived from living things, and shredded waste tatamis, shredded waste construction woods, wood chips and saw dusts correspond thereto, for example.

As mentioned above, the combustible waste flow channel is provided with the upward slope near the injection port (the cement kiln side end portion). The upward slope is installed in the bottom portion of the combustible waste flow channel which is positioned in a vertically lower side from a horizontal plane including an axis center when the combustible waste flow channel is cut by a plane orthogonal to the axis center. The upward slope is installed within the combustible waste flow channel, and the combustible waste is therefore ejected into the cement kiln in an upward direction. As a result, the combustible waste (the supplemental fuel) injected into the cement kiln from the combustible waste injection device can keep a floating state within the cement kiln for a long period of time, and is moved far (to a kiln tail side) within the cement kiln, so that the combustion can be completed without inhibiting a cement clinker formation reaction.

The inclined surface may be positioned at a position where an opposite end portion to the injection port of the combustible waste flow channel in the axial direction is between 150 mm and 2000 mm away from the injection port, and an elevation angle thereof may be between 1 degree and 4 degrees. An injection port side end portion of the inclined surface may match up with the injection port, and may be formed by a flat plane from the inclined surface to the injection port as well as being positioned at a position which is about several centimeters away from the injection port in the axial direction.

By setting the installed position and the elevation angle of the inclined surface within the numerical value range mentioned above, it is possible to make a ratio $S/S_0$ of an area S ($cm^2$) of the injection port in the case where the upward slope is installed in relation to an area $S_0$ ($cm^2$) of the injection port in the case where the upward slope is not installed, greater than 0.5, in the combustible waste flow channel in which an inner diameter is a common magnitude between 150 mm and 200 mm. Therefore, the combustible waste flow is discharged out of the combustible waste flow channel into the cement kiln without being exposed to an excessive pressure loss.

The combustible waste injection device may be provided with an air inflow port (hereinafter, referred to as "assist air inflow port") which can flow an air flow (hereinafter, referred to as "assist air flow") into the combustible waste flow channel toward the axis center of the combustible waste flow channel at a position where the inclined surface is formed in the combustible waste flow channel, and the assist air inflow port may be arranged at a plurality of positions in a circumferential direction.

In particular, the assist air inflow port is preferably arranged at a plurality of positions sandwiching in a vertical direction a horizontal plane including the axis center of the combustible waste flow channel when cutting with a plane orthogonal to the axis center of the combustible waste flow channel.

According to the structure mentioned above, the assist air flow is flowed into toward the axis center of the combustible waste flow channel at the position where the inclined surface (the upward slope) is formed, that is, near the injection port of the combustible waste flow channel. Therefore, the combustible waste is ejected while being moderately diffused in a vertical direction within the cement kiln as well as being ejected in an upward direction from the injection port of the combustible waste flow channel. As a result, a mixing state of the main fuel and the combustible waste (the supplemental fuel) is improved, the main fuel being injected into the cement kiln from the powdered-solid-fuel flow channel positioned so as to surround the injection port of the combustible waste injection device. Further, the main fuel is well mixed with a high-temperature air (a secondary air) supplied into the cement kiln from a cement cooler. On the basis of simultaneous processes of these mixings, an environment that the combustible waste and the main fuel can be efficiently burnt while moderately mixing is formed in the cement kiln. As a result, a combustion velocity of the combustible waste within the cement kiln is accelerated and the combustion of the combustible waste can be completed in the floating state as mentioned above, since the preferable combustion environment of the combustible waste is formed.

The combustible waste injection device may be provided at a position outside the combustible waste flow channel, with an assist air flow channel which is installed in parallel to the combustible waste flow channel, and the assist air flow channel may be communicated with the combustible waste flow channel via the assist air inflow port and be shielded from the combustible waste flow channel in an upstream side of the assist air inflow port.

An air flow rate flowing in the assist air flow channel is preferably structured such as to be independently controllable during operation, so as to eject the combustible waste flow flowing in the combustible waste flow channel upward in the vertical direction after reducing in the direction of the axis center. As a result, it is possible to easily regulate for maintaining an optimum flame state of the cement kiln burner while continuing an operation of the cement kiln burner even if the kind of the used powdered-solid-fuel (main fuel) and combustible waste (supplemental fuel) and a rate of using them change.

In the structure mentioned above, the combustible waste flow channel is provided at a predetermined distance from the injection port, with a plurality of assist air inflow ports which are communicated with the assist air flow channel. In this structure, the flow rate of the assist air flowing into the combustible waste flow channel through each of the assist air inflow ports is preferably structured such as to be independently controllable per assist air flow channel by a blower or a flow rate regulating valve which is connected to each of the assist air flow channel.

Further, more preferably, an air flow rate (referred to as "upward assist air flow rate) flowed into the combustible waste flow channel from the assist air inflow port positioned in a vertically lower side from a horizontal plane including the axis center when cutting with a plane orthogonal to the axis center of the combustible waste flow channel is equal to or more than an air flow rate (referred to as "downward assist air flow rate") flowed into from a vertically upper side of the horizontal plane. As a result, the floating state of the combustible waste continues for a long period of time within the cement kiln and the combustion of the combustible waste can be completed in the floating state, as mentioned above, since the combustible waste is discharged with an elevation angle which is further greater than the elevation angle caused by the upward slope, from the injection port of the combustible waste injection device.

In particular, by regulating the air flow rate flowed into the combustible waste flow channel from the assist air inflow port or further regulating the rate between the upward assist air flow rate and the downward assist air flow rate, it is possible to control so that a shape of the flame from the cement kiln burner and a temperature distribution do not fluctuate even with the change in a rate of the supplemental fuel used in the cement kiln burner [=(supplemental fuel)/(main fuel+supplemental fuel)], and/or the kind or the property of the combustible waste used as the supplemental fuel.

Further, on the basis of the regulation of the rate between the upward assist air flow rate and the downward assist air flow rate, the elevation angle can be substantially regulated when the combustible waste is discharged into the cement kiln. More specifically, in the case where the elevation angle of the inclined surface (the upward slope) is insufficient, it is possible to enhance an effect of continuing the floating state of the combustible waste within the cement kiln by enhancing the rate of the upward assist air flow rate so as to increase the elevation angle of the substantially discharged combustible waste flow.

Further, the assist air inflow port may be arranged at a plurality of positions sandwiching the vertical plane including the axis center in the horizontal direction when the combustible waste flow channel is cut by the plane orthogonal to the axis center. As a result, the combustible waste flow is exposed to the assist air flow having an equal air flow rate from a lateral direction, and is throttled in the lateral direction in addition to the vertical direction, thereby well occurring the state in which the combustible waste within the cement kiln after being injected from the combustible waste injection device diffuses while floating in whole circumferential directions including the vertical and lateral directions. According to this fact, a good mixing state between the main fuel, the secondary air and the combustible waste mentioned above is more securely formed around a whole circumference.

The assist air inflow port may be installed in a range between 10 mm and 600 mm from the injection port of the combustible waste flow channel. Within this range, the combustion of the combustible waste can be completed and promoted in the floating state in the combustible waste injection device which is provided with the combustible waste flow channel having a general inner diameter between 150 mm and 200 mm, and is operated at a general primary air flow rate (60 $m^3$/min to 120 $m^3$/min). The assist air inflow port may be arranged circumferentially over one circle, or may be arranged over two or more circles, that is, in a plurality or rows.

The shape of the assist air inflow port is not limited as long as the assist air inflow port throttles the flow of the combustible waste (combustible waste flow) fed by the primary air into the direction of the axis center. In the light of the throttle effect easily obtained by the assist air, the assist air inflow port is preferably formed into a circular shape having a diameter between 5 mm and 25 mm, or formed into a rectangular shape (a slit shape) having a long side in a peripheral direction and a short side in a flow channel direction and having a short side length between 3 mm and 15 mm. In the case where the assist air inflow port is formed into the circular shape, the assist air inflow ports may be arranged circumferentially at regular intervals, or may be arranged unequally spaced. In the latter case, it is preferable to arrange unequally spaced so that the assist air inflow ports are highly distributed near an intersection (a top portion and a bottom portion) between the vertical axis and the inner surface of the combustible waste flow channel when the combustible waste flow channel is cut by the plane orthogonal to the axis center.

Further, the assist air inflow port may be provided with an assist air delivery tool which can regulate an inflow angle of the assist air flow flowed into the combustible waste flow channel with respect to the flow feeding direction of the combustible waste flow which flow feeds within the combustible waste flow channel.

Further, the present invention is a method for operating the combustible waste injection device, characterized in that the combustible waste flow is ejected from the combustible waste flow channel vertically upward from the horizontal plane.

At this time, it is preferable to set an upward assist air flow rate flowed into from the vertically lower side of the horizontal plane to be equal to or more than a downward assist air flow rate flowed into from the vertically upper side of the horizontal plane, while applying the elevation angle at the steady operation time with the upward slope. In this case, the ratio of the downward assist air flow rate in relation to the upward assist air flow rate is preferably set between 0.5 and 1.0. In the case where the ratio of the downward assist air flow rate in relation to the upward assist air flow rate is 1.0, the effect of applying the elevation angle to the combustible waste flow by the assist air is not generated, however, it is possible to obtain an effect that the combustible waste diffuses within the cement kiln by throttling the combustible waste flow.

Further, a total amount ($m^3$/min) of the air flow rates flowed into the combustible waste flow channel from the assist air inflow port can be set to 5 volume % to 65 volume % of the primary air flow rate ($m^3$/min) flowing in the combustible waste flow channel. In the method for operating the combustible waste injection device, the primary air flow rate flowing in the combustible waste flow channel is not restricted, but can employ a normal condition for operating.

Further, the inflow angle of the assist air flow flowed into the combustible waste flow channel may be greater than 0 degrees and equal to or less than 90 degrees with respect to the flow feeding direction of the combustible waste flow which flow feeds within the combustible waste flow channel. According to the structure mentioned above, the assist air flow is inhibited from coming into collision in an opposite direction to the flow feeding direction of the combustible waste flow, and the combustible waste flow can be therefore ejected from the injection port in the state in which the combustible waste flow is reduced in the direction of the axis center, without preventing the combustible waste flow more than necessary.

Effect of the Invention

According to the combustible waste injection device and the method for operating the same of the present invention, it is possible to optionally change the rate of using the powdered-solid-fuel (the main fuel) and the combustible waste (the supplemental fuel) such as the waste plastic piece while maintaining the optimum state of the flame from the cement kiln burner, and it is possible to effectively utilize the combustible waste (the supplemental fuel), for example, having a particle size of 30 mm or less.

MODE FOR CARRYING OUT THE INVENTION

A description will be given below of embodiments of a combustible waste injection device and a method for operating the same according to the present invention with reference to the accompanying drawings. The following drawings are schematically shown, and dimension ratios of the drawings do not match up with actual dimension ratios.

Figure 1:
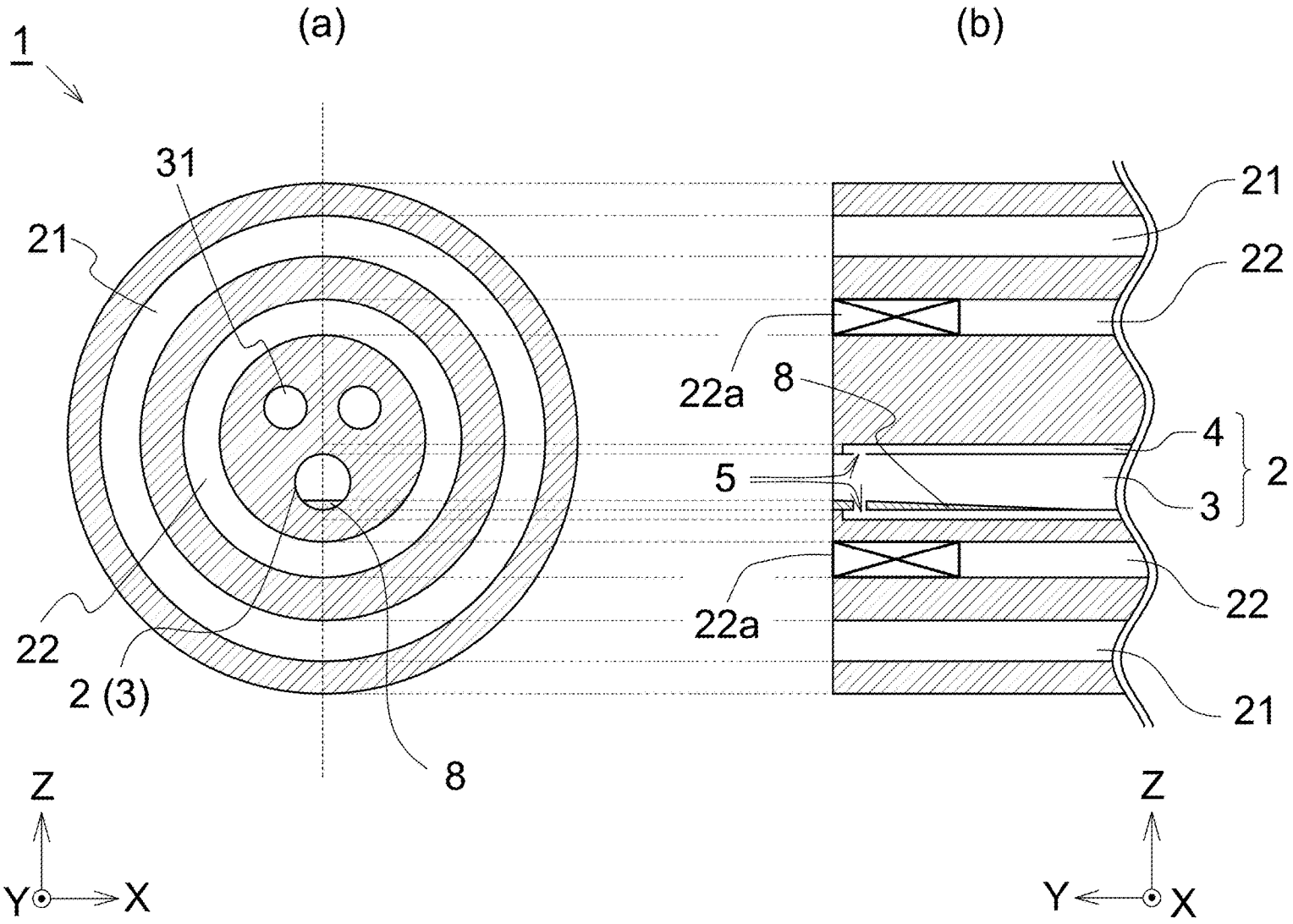
FIG. 1 is a view schematically showing a center portion at a tip end portion of an embodiment of a cement kiln burner device to which a combustible waste injection device according to the present invention is attached.

FIG. 1 is a view schematically showing a center portion of a tip end portion in an embodiment of a cement kiln burner device to which a combustible waste injection device according to the present invention is attached. In FIG. 1, FIG. 1(*a*) is a horizontal cross sectional view of the cement kiln burner device including the attached combustible waste injection device, and FIG. 1(*b*) is a vertical cross sectional view of the same. The horizontal cross sectional view indicates a cross sectional view obtained by cutting the cement kiln burner device with a plane which is orthogonal to an axial direction of the device, and the vertical cross sectional view indicates a cross sectional view obtained by cutting the cement kiln burner device with a plane which is parallel to the axial direction of the device.

In FIG. 1, a coordinate system is set by setting the axial direction of the cement kiln burner device (a direction of a primary air flow) to a Y direction, a vertical direction to a Z direction, and a direction which is orthogonal to a YZ plane to an X direction. In the following description, a description will be given by appropriately referring to the XYZ coordinate system. Describing by using the XYZ coordinate system, FIG. 1(*a*) corresponds to a cross sectional view when the cement kiln burner device is cut by the XZ plane, and FIG. 1(*b*) corresponds to a cross sectional view when the cement kiln burner device is cut by the YZ plane. In more detail, FIG. 1(*b*) corresponds to a cross sectional view when the cement kiln burner device is cut by the YZ plane in a cement kiln side end portion (a leading end surface of the cement kiln burner device).

Each of XYZ coordinate systems illustrated in FIGS. 2A to 4B, 6 and 7 mentioned later has the same axial relationship as the XYZ coordinate system illustrated in FIG. 1.

As shown in FIG. 1(*a*), a combustible waste flow channel 3 of a combustible waste injection device 2 attached to a cement kiln burner device 1 is arranged in an inner side of a powdered-solid-fuel flow channel 21 which is concentrically arranged in the cement kiln burner device 1, and at least one air flow channel 22 which is arranged inside in adjacent to the powdered-solid-fuel flow channel 21. An oil flow channel 31 for supplying a heavy oil can be arranged in an inner side of the air flow channel 22 in adjacent to the combustible waste flow channel 3 of the combustible waste injection device 2.

In FIG. 1, the air flow channel 22 has a swirl vane 22*a* serving as a swirling means in a cement kiln side end portion (in the vicinity of the injection port side). More specifically, an air flow ejected out of the air flow channel 22 forms a swirl air flow which is positioned inside a powdered-solid-fuel flow ejected out of the powdered-solid-fuel flow channel 21. The swirl vane 22*a* may be structured such that a swirl angle can be adjusted at a time point before the cement kiln burner device 1 starts operation.

As shown in FIG. 1(*b*), in an inner portion of the cement kiln burner device 1, on a bottom surface of the combustible waste flow channel 3 is formed an upward slope 8 near the injection port side in a vertical direction (Z direction). The upward slope 8 corresponds to "inclined surface". Further, in the present embodiment, as shown in FIG. 1(*b*), in the inner portion of the cement kiln burner device 1, an assist air flow channel 4 is provided in an outer side of the combustible waste flow channel 3, and is structured such that an assist air can flow into the combustible waste flow channel 3 via an assist air inflow port 5. In this regard, a description will be given below with reference to FIGS. 2A and 2B.

The upward slope 8 is not limited in its specific mode and method as long as the bottom surface of the combustible waste flow channel 3 is formed with a slope. As an example, an inner wall surface itself of the combustible waste flow channel 3 may form the upward slope 8 by forming so that a thickness of an inner wall corresponding to the bottom portion of the combustible waste flow channel 3 becomes thicker little by little within a predetermined area in the Y direction. As the other example, a surface of another member may form the upward slope 8 by providing another member having a height which is changed little by little toward the Y direction, on an inner wall corresponding to the bottom portion of the combustible waste flow channel 3 within a predetermined area in the Y direction. In any case, the upward slope 8 is formed in the combustible waste flow channel 3, so that a flow channel width of the combustible waste flow channel 3 in the vertical direction is narrowed toward the injection port.

Figure 2A:
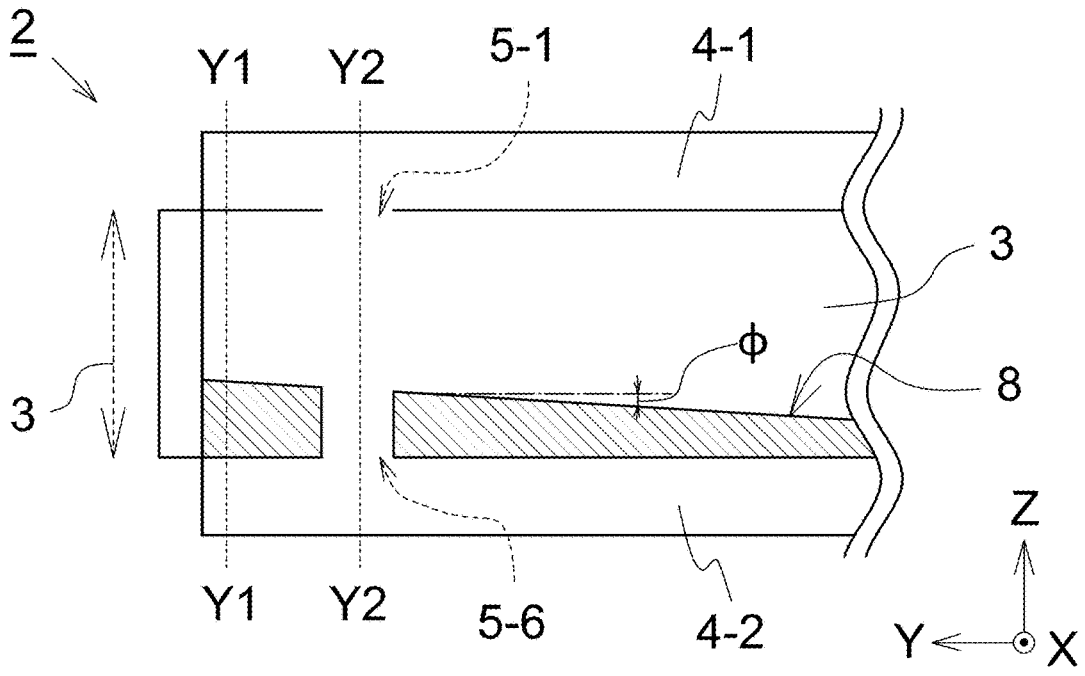
FIG. 2A is a vertical cross sectional view schematically showing a tip end portion of the embodiment of the combustible waste injection device according to the present invention.
Figure 2B:
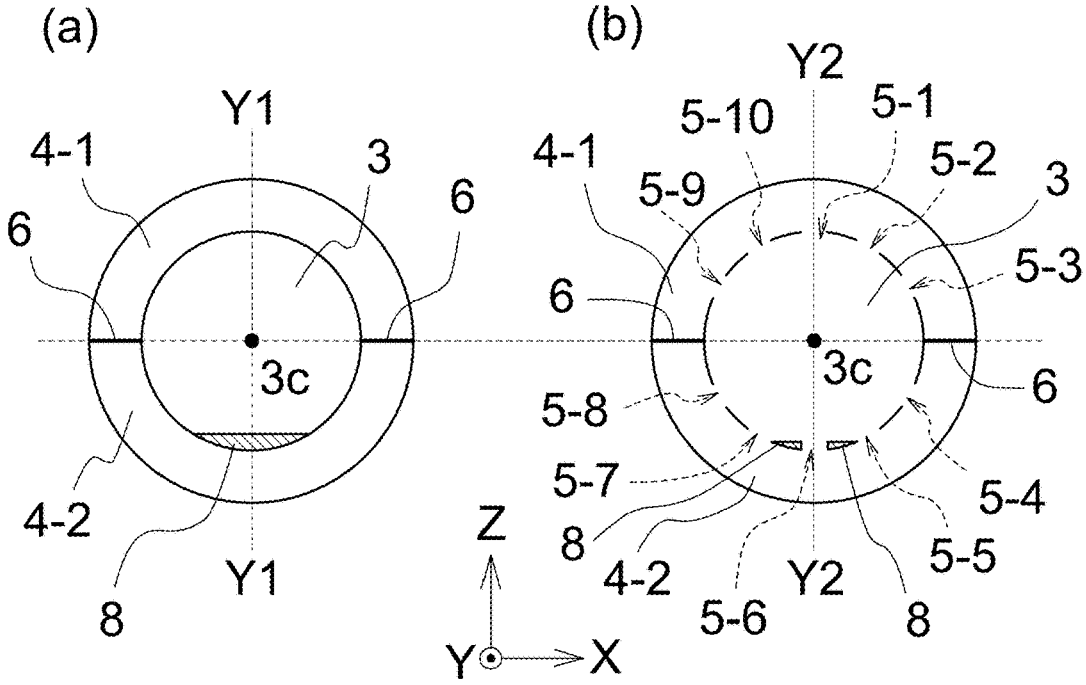
FIG. 2B is a horizontal cross sectional view schematically showing the tip end portion of the embodiment of the combustible waste injection device according to the present invention.

FIGS. 2A and 2B are views schematically showing a tip end portion of an embodiment of the combustible waste injection device 2 according to the present invention. FIG. 2A is a vertical cross sectional view of the combustible waste injection device 2, and FIG. 2B is a horizontal cross sectional view (corresponding to (a)) at a position where a Y-coordinate in FIG. 2A is Y1 (hereinafter, abbreviated simply to as "position of Y1"), and a horizontal cross sectional view (corresponding to (b)) at a position where the Y-coordinate is Y2 (hereinafter, abbreviated simply to as "position of Y2"). The position of Y1 corresponds to the vicinity of the tip end portion of the combustible waste flow channel 3 (that is, the vicinity of the injection port), and the position of Y2 corresponds to a position in an upstream side of the position of Y1 and away from the tip end portion of the combustible waste flow channel 3.

Further, as shown in FIG. 2A, the upward slope 8 is formed in the bottom surface of the combustible waste flow channel 3. In the upward slope 8, an elevation angle $\phi$ (angle of inclination) in relation to the horizontal plane (XY plane) is between 1 degree and 4 degrees. Further, the upward slope 8 is formed toward the injection port from a position which is 150 mm to 2000 mm away from the injection port in the Y direction.

Further, in the present embodiment, as shown in FIG. 2B, the assist air flow channel 4 is arranged in an outer side of the combustible waste flow channel 3. In more detail, the assist air flow channel 4 according to the present embodiment is concentrically arranged in an outer side of the combustible waste flow channel 3 formed into a cylindrical shape, and is divided by a partition member 6 into two flow channels, a vertically upper side assist air flow channel 4-1 and a vertically lower side assist air flow channel 4-2.

As shown in FIG. 2B(b), an assist air inflow port 5 communicating the assist air flow channel 4 (4-1 and 4-2) and the combustible waste flow channel 3 is installed at the position of Y2, and is structured such that the assist air flowing through the assist air flow channel 4 can flow into the combustible waste flow channel 3 toward an axis center 3*c* of the combustible waste flow channel 3. In the present embodiment, the combustible waste flow channel 3 is provided at the position of Y2, with assist air inflow ports 5 (5-1 to 5-10) which are arranged at ten positions in a circumferential direction. In more detail, five assist air inflow ports (5-1 to 5-3, 5-9 and 5-10) are arranged in the assist air flow channel 4-1 side (vertically upper side), and five assist air inflow ports (5-4 to 5-8) are arranged in the assist air flow channel 4-2 side (vertically lower side).

In FIG. 2A, for convenience of illustration, only the assist air inflow ports (5-1 and 5-6) appear on the drawing among ten assist air inflow ports 5 (5-1 to 5-10).

A dedicated blower (not shown) or flow rate regulating valve (not shown) is connected to each of the assist air flow channels (4-1 and 4-2), and can independently control the assist air flow rate which is delivered to each of the assist air flow channels (4-1 and 4-2).

Figure 3:
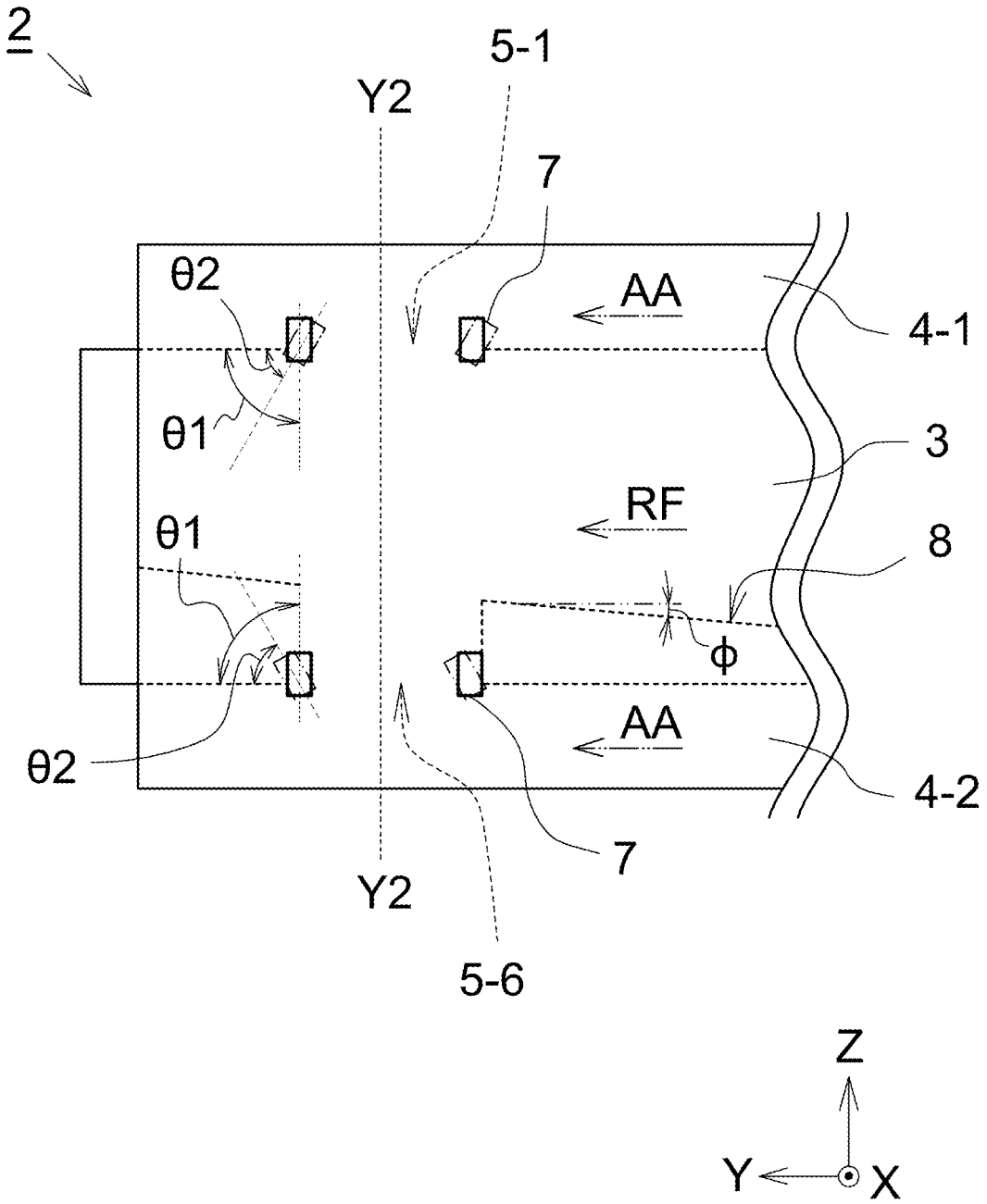
FIG. 3 is a partially enlarged view of FIG. 2A.

FIG. 3 is a view schematically showing the tip end portion of the embodiment of the combustible waste injection device 2 according to the present invention shown in FIG. 2A by enlarging a periphery of the assist air inflow ports (5-1 and 5-6).

As shown in FIG. 3, an assist air delivery tool 7 is installed in the assist air inflow ports (5-1 and 5-6) communicating the combustible waste flow channel 3 and the assist air flow channel 4. The assist air delivery tool 7 is provided for controlling an inflow angle $\theta$ ($\theta$1 and $\theta$2) which a direction of the assist air AA flowed into the combustible waste flow channel 3 forms with respect to the direction of the combustible waste RF flowing within the combustible waste flow channel 3. In FIG. 3, there are schematically shown respective modes of the assist air delivery tool 7 in the case of the inflow angle $\theta=\theta$1, and the case of the inflow angle $\theta=\theta$2.

The inflow angle $\theta$ can be made more than 0 degrees and equal to or less than 90 degrees. In the case where the inflow angle $\theta$ of the assist air AA is 0 degrees, an effect of changing the flow of the combustible waste RF by the assist air AA can be hardly obtained, and in the case where the inflow angle $\theta$ goes beyond 90 degrees, the flow of the combustible waste RF is decelerated by the assist air AA and is excessively agitated. As a result, both the cases are not preferable.

Figure 4A:
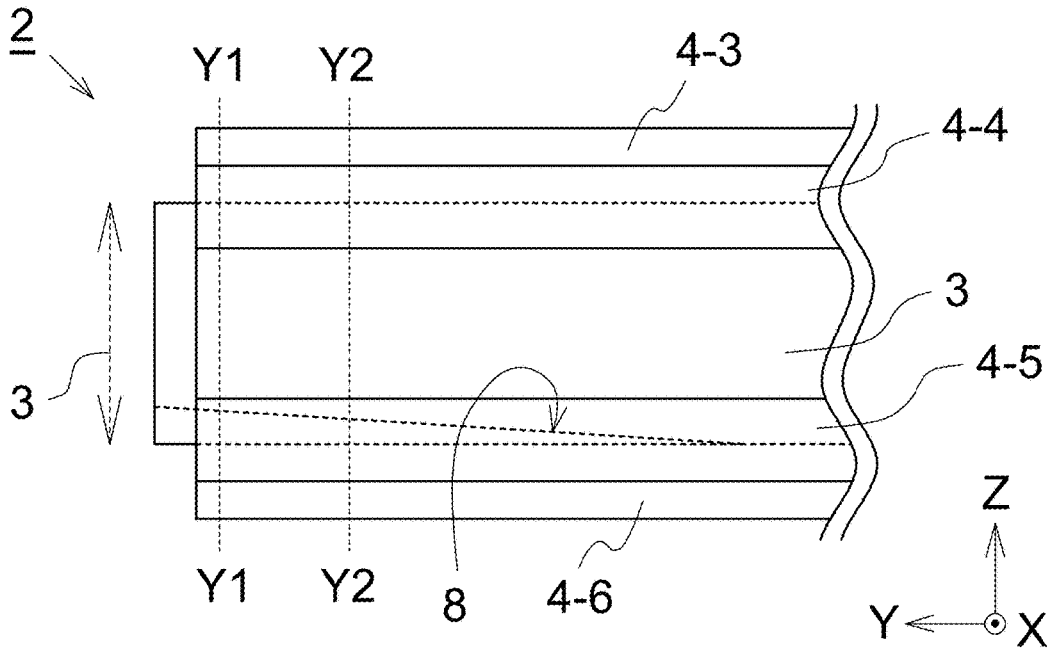
FIG. 4A is a vertical cross sectional view schematically showing a tip end portion of the other embodiment of the combustible waste injection device according to the present invention.
Figure 4B:
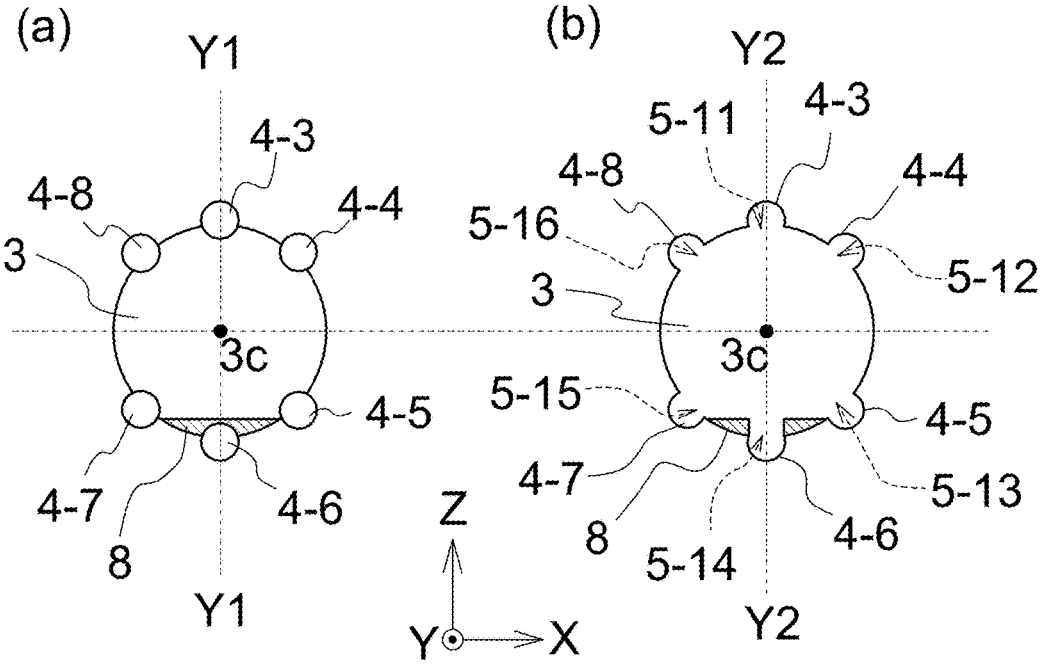
FIG. 4B is a horizontal cross sectional view schematically showing the tip end portion of the other embodiment of the combustible waste injection device according to the present invention.

FIGS. 4A and 4B are views schematically showing a tip end portion of the other embodiment of the combustible waste injection device 2 according to the present invention. FIG. 4A is a vertical cross sectional view of the combustible waste injection device 2 in the same manner as FIG. 2A, and FIG. 4B is a horizontal cross sectional view (corresponding to (a)) at a position of Y1 in FIG. 4A and a horizontal cross sectional view (corresponding to (b)) at a position of Y2, in the same manner as FIG. 2B. For convenience of illustration, the assist air inflow port 5 is not illustrated in FIG. 4A.

In the embodiment shown in FIG. 4B, the combustible waste flow channel 3 is provided at the position of Y2, with assist air inflow ports 5 (5-11 to 5-16) which are arranged at six positions in a circumferential direction. Further, the combustible waste flow channel 3 is provided with dedicated assist air flow channels (4-3 to 4-8) every assist air inflow ports (5-11 to 5-16). As a result, the assist air flow rates supplied to the respective assist air flow channels (4-3 to 4-8) can be independently controlled by respectively connecting dedicated blowers (not shown) or flow rate regulating valves (not shown) to the assist air flow channels 4-3 to 4-8. A description will be given of this regard with reference to FIG. 5.

Figure 5:
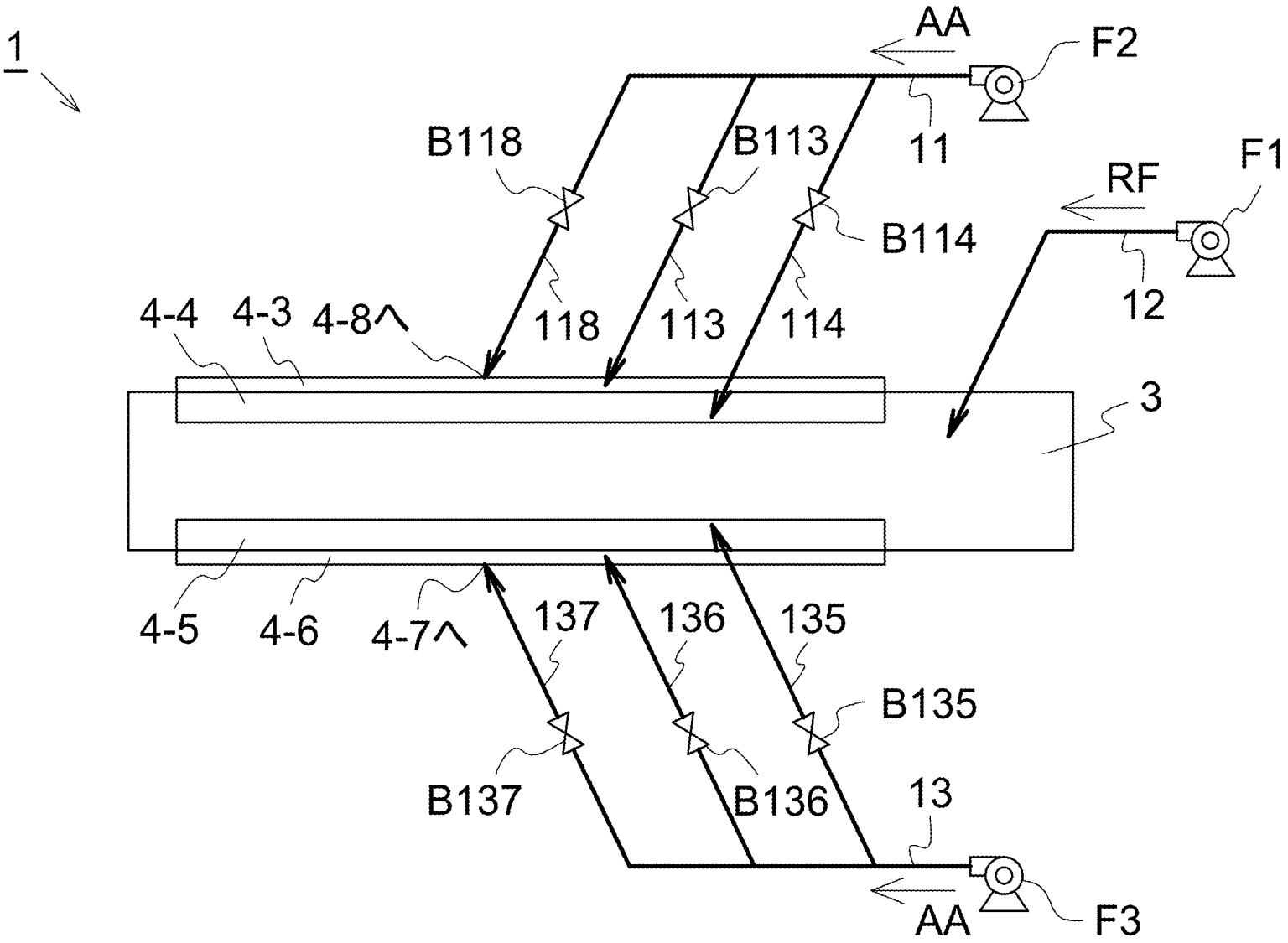
FIG. 5 is a view schematically showing an example of a structure of the combustible waste injection device shown in FIGS. 4A and 4B.

FIG. 5 is a view schematically showing an example of a structure of the combustible waste injection device shown in FIG. 4. The combustible waste injection device 2 illustrated in FIG. 5 is constructed by valuing an easy control, and is provided with three blowing fans (F1 to F3), and six flow rate regulating valves (B113, B114, B118, B135, B136, and B137). The flow rate regulating valves (B113, B114, B118, B135, B136, and B137) are constructed, for example, by a gas valve.

The combustible waste RF supplied to a combustible waste transfer pipe 12 is supplied to the combustible waste flow channel 3 of the combustible waste injection device 2 by an air flow formed by the blowing fan F1. The air supplied from the blowing fan F2 is supplied as an assist air AA to the assist air flow channel 4 (4-3, 4-4, and 4-8) via an air pipe 11. In more detail, the air pipe 11 is branched by three branched pipes (113, 114, and 118), and the branched pipes are respectively communicated with the three assist air flow channels (4-3, 4-4, and 4-8). In the same manner, the air pipe 13 supplying the assist air AA from the blowing fan F3 is branched by three branched pipes (135, 136, and 137) and are communicated with three assist air flow channels (4-5, 4-6, and 4-7).

The branched pipes (113, 114, 118, 135, 136, and 137) are respectively provided with variable type flow rate regulating valves (B113, B114, B118, B135, B136, and B137), and the flow rate of the assist air AA circulating the branched pipes (113, 114, 118, 135, 136 and 137) can be independently controlled by regulating opening degrees of the flow rate regulating valves mentioned above.

More specifically, in the case of the combustible waste injection device 2 shown in FIGS. 4A, 4B and 5, the flow rate of the assist air AA can be independently every assist air inflow ports 5 (5-11 to 5-16) since the assist air inflow ports 5 (5-11 to 5-16) are provided in correspondence to the respective assist air flow channels 4 (4-3 to 4-8). As a result, it is possible to optionally change a rate of using the powdered-solid-fuel (the main fuel) and the combustible waste (the supplemental fuel) while maintaining the optimum state of the flame from the cement kiln burner.

Further, the combustible waste flow can be ejected from the combustible waste flow channel 3 vertically upward (+Z direction) of the horizontal plane (XY plane) since the upward slope 8 is formed on the bottom surface near the injection port of the combustible waste flow channel 3. As a result, it is possible to continue the floating state of the combustible waste within the cement kiln for a long period of time.

Figure 6:
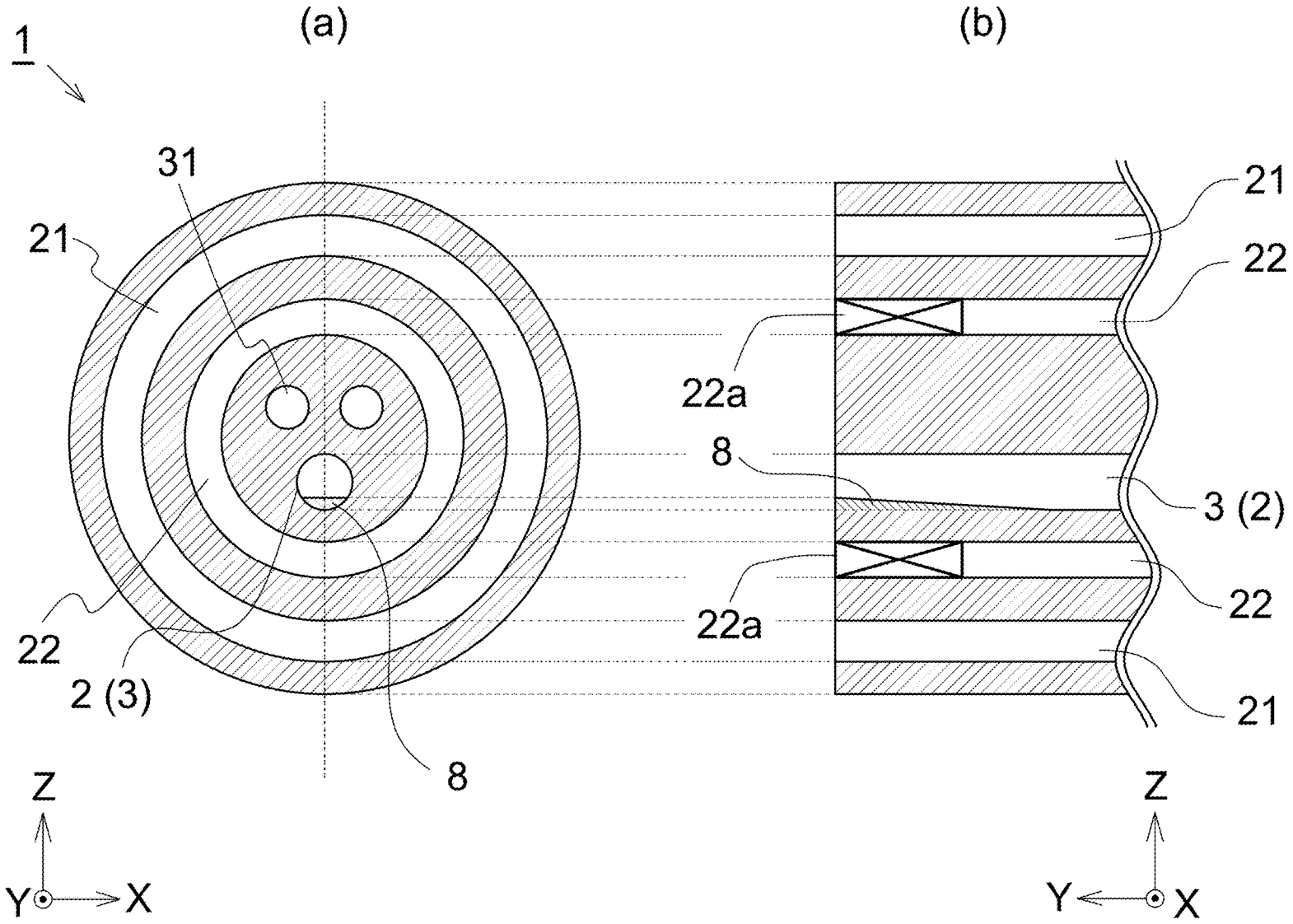
FIG. 6 is a view schematically showing a center portion at a tip end portion of the other embodiment of the cement kiln burner device to which the combustible waste injection device according to the present invention is attached.

More specifically, as shown in FIG. 6, the combustible waste injection device 2 according to the present invention may be provided with neither assist air flow channel 4 nor assist air inflow port 5 while being provided with the upward slope 8 in the bottom surface of the combustible waste flow channel 3. However, the effect of ejecting the combustible waste flow further vertically upward can be regulated by providing the assist air flow channel 4 and the assist air inflow port 5 and making the assist air AA flow into toward the axis center direction of the combustible waste flow channel 3 such as the combustible waste injection device 2 shown in FIG. 1. Therefore, it is possible to further enhance an effect of setting the floating state of the combustible waste RF within the cement kiln to a preferable state.

The inventors of the present invention have found a basic limitation region for optimizing a control factor of the combustible waste injection device 2 by analyzing a flame shape from the cement kiln burner, a gas temperature distribution within the cement kiln, an oxygen concentration distribution within the cement kiln and a degree of an air flow turbulence within the cement kiln according to a combustion simulation (software: FLUENT produced by ANSYS JAPAN K. K.) of the cement kiln burner device 1 having the combustible waste injection device 2 attached thereto.

Figure 7:
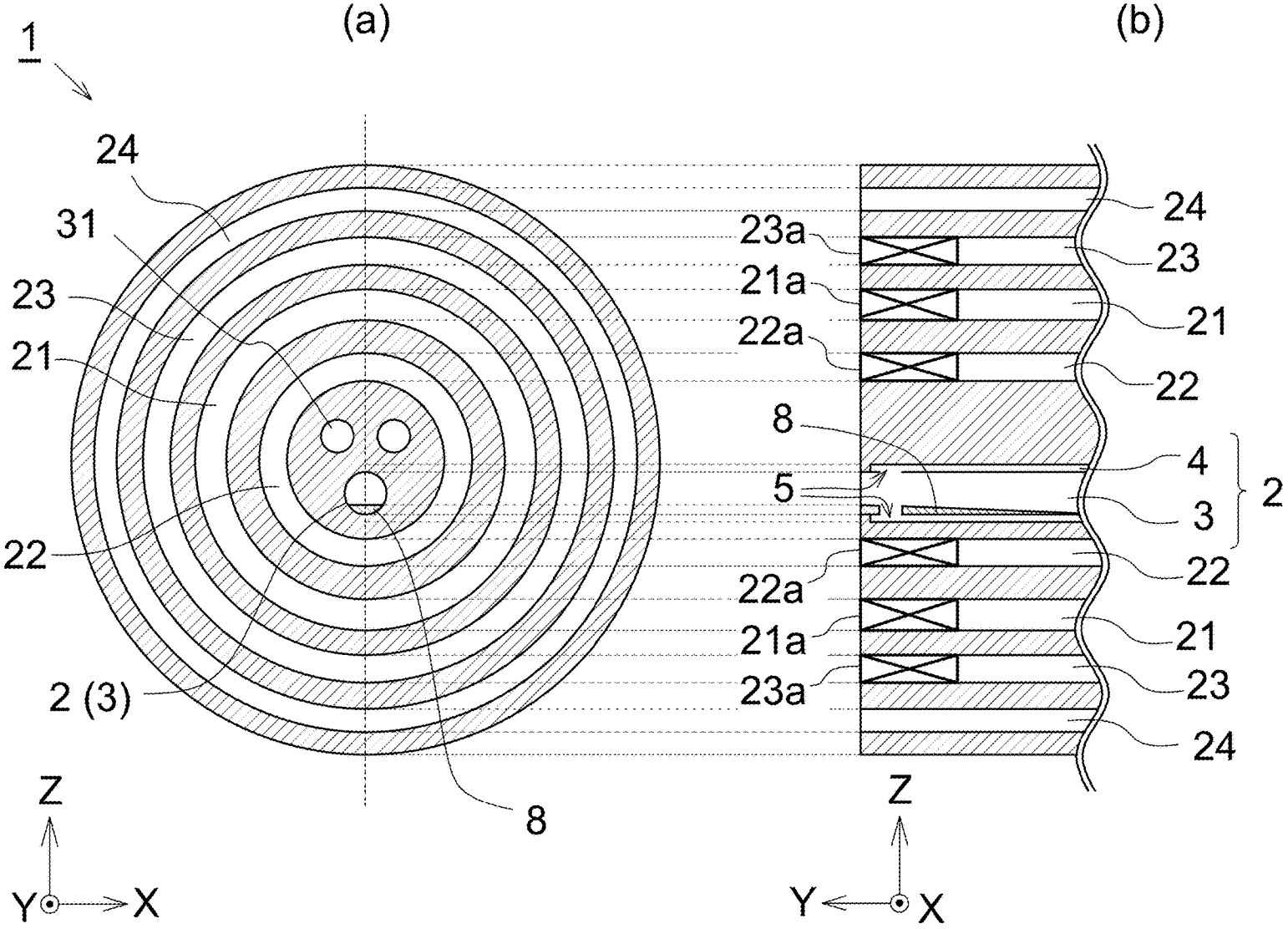
FIG. 7 is a view schematically showing a tip end portion of an embodiment of a cement kiln burner device to which a combustible waste injection device used in simulation is attached.

FIG. 7 schematically illustrates the structure of the cement kiln burner device 1 including the combustible waste injection device 2 used in the present simulation following to FIG. 1. The cement kiln burner device 1 shown in FIG. 7 is provided in addition to the structure shown in FIG. 1 with an air flow channel 23 which is arranged in an outer side of a powdered-solid-fuel flow channel 21 and has a swirl vane 23*a* arranged therein, and an air flow channel 24 which is arranged further outside the air flow channel 23. The air flow channel 24 is a flow channel which forms a straight air flow. More specifically, the cement kiln burner device 1 of a subject to be investigated by simulation is a so-called four-channel type burner device including totally four flow channels; an air flow channel 22 forming a swirl air flow, a powdered-solid-fuel flow channel 21 forming a swirl main fuel flow, an air flow channel 23 forming a swirl air flow, and an air flow channel 24 forming a straight air flow, from an inner side, as shown in FIG. 7(*a*).

Example 1 mentioned later is a structure in which the cement kiln burner device 1 shown in FIG. 7 is provided with neither the assist air flow channel 4 nor the assist air inflow port 5, and corresponds to a structure in which the cement kiln burner device 1 in FIG. 6 is changed to 4-channel type.

The following Table 1 is an example of the basic limitation region according to the combustible waste injection device 2 which has been found under the specification and the condition for operating of the following cement kiln burner device 1. Table 1 corresponds to the embodiment of the combustible waste injection device 2 exemplified in FIG. 2.

<Specification of Cement Kiln Burner Device 1>

Number of channels: four channels (swirl air flow, swirl main fuel flow, swirl air flow and straight air flow from innermost shell side)

Combustible waste injection device 2: arranged in an inner side of an air flow channel 22 forming the swirl air flow and attached to a lower side of an axis center of the cement kiln burner device 1

Diameter of burner tip of cement kiln burner device 1: 700 mm

Inner diameter of injection port of combustible waste injection device 2: 175 mm Forming area of upward slope 8: area from a position which is 300 mm in −Y direction from an injection port (end portion) of a combustible waste flow channel 3, to the injection port (end portion)

Assist air inflow port 5: five circular holes having diameter of 16 mm in each of an upper side and a lower side in a vertical direction (30 degrees intervals in a range ±60 degrees with respect to vertical axis)

<Condition for Operating Cement Kiln Burner Device 1>

The amount of combustion of main fuel C flowing in powdered-solid-fuel flow channel 21: 12 t/hour The amount of waste plastic (non-rigid plastic) which was processed as combustible waste RF: 5 t/hour The dimension of waste plastic serving as combustible waste RF: circular sheet shape obtained by punching a sheet having a thickness 0.5 mm with a diameter 30 mm The primary air flow rate (total amount of four channels) and temperature: 15000 $Nm^3$/hour, 30° C.

The secondary air flow rate and temperature: 100000 $Nm^3$/hour, 900° C.

The primary air flow rate from combustible waste injection device 2 and temperature: 5000 $Nm^3$, 30° C.

The blowing method of assist air AA from combustible waste injection device 2 and temperature: the assist air AA is added in a state in which the primary air flow rate from the combustible waste injection device 2 keeps the above value, 30° C.

TABLE 1

| Cement kiln burner device 1 in FIG. 7 | |
|---|---|
| Elevation angle φ of upward slope 8 | $1° \leq \varphi \leq 4°$ |
| Assist air flow rate | 5 volume % to 65 volume % of primary air amount of combustible waste injection device 2 |
| Rate r in vertical direction of assist airflow rate | (downward assist airflow rate)/(upward assist airflow rate) is 0.5 to1.0 |
| Position of assist air inflow port 5 | 10 nun to 600 nun from injection port (end portion) of combustible waste flow channel 3 |
| Inflow angle 9 of assist air | $0° \leq \theta \leq 90°$ |

In Table 1, there are listed as basic limitation regions an elevation angle φ of the upward slope 8, an assist air AA flow rate (volume % of all the assist air flow rates in relation to a primary air flow rate of the combustible waste injection device 2), a rate r of each of the assist air flow rates flowed into from a vertically upper side of a horizontal plane including an axis center and flowed into from a vertically lower side of the horizontal plane including the axis center [(downward assist air flow rate)/(upward assist air flow rate)], a distance (mm) of the assist air inflow port 5 from an end portion of the combustible waste flow channel 3, and an inflow angle (°) of the assist air AA flowed into the combustible waste flow channel 3 from the assist air inflow port 5.

Among the items mentioned above, the elevation angle φ of the upward slope 8, the flow rate of the assist air AA, the position of the assist air inflow port 5, and the rate r of the assist air AA amount in the vertical direction are important.

As mentioned above, it is necessary to form a good mixed state of the combustible waste RF, the main fuel C and the secondary air in order to facilitate regulation for obtaining a stable flame even when the fuel composition used for the cement kiln burner device 1 changes. In spite of the above fact, it is possible to regulate a degree of throttling of the combustible waste flow flowing through the combustible waste flow channel 3 by regulating the flow rate of the assist air AA, whereby it is possible to independently regulate a degree of diffusion of the combustible waste RF ejected out of the combustible waste injection device 2 during operation.

Taking into consideration the circumstance mentioned above, a flow rate V ($Nm^3$/hour) of the assist air AA flowed into the combustible waste flow channel 3 from the assist air inflow port 5 per unit time is preferably between 5 volume % and 65 volume % of a primary air flow rate $V_0$ ($Nm^3$/hour) flowing through the combustible waste flow channel 3. In the case where $V/V_0$ is less than 5 volume %, a throttle effect of the combustible waste flow cannot be obtained by the assist air AA, and in the case where $V/V_0$ goes beyond 65 volume %, the degree of diffusion of the combustible waste flow is enlarged, so that a part of the combustible waste RF may come into collision with an upper inner wall of the cement kiln. Further, in the case where the combustible waste is diffused in such a degree that a part of the combustible waste RF comes into collision with the kiln inner wall, the flame shape of the cement kiln burner is greatly disturbed, so that the quality of the cement clinker becomes unstable and the heat loss of the firebrick within the cement kiln is enlarged.

Further, the degree of diffusion of the combustible waste RF ejected out of the combustible waste injection device 2 can be regulated by changing the position (in more detail, the position in the Y direction) of the assist air inflow port 5 in the case where the flow rate of the assist air AA is fixed.

Taking into consideration the circumstance mentioned above, a distance in the Y direction from the injection port (end portion) of the combustible waste flow channel 3 to the assist air inflow port 5 is preferably within a range between 10 mm and 600 mm. In the case where the distance mentioned above is less than 10 mm, the degree of diffusion of the flow of the combustible waste RF is enlarged, and a part of the combustible waste RF may come into collision with the upper inner wall of the cement kiln. Further, in the case where the distance in the Y direction from the injection port of the combustible waste flow channel 3 to the assist air inflow port 5 goes beyond 600 mm, the diffusion effect of the combustible waste RF generated by the assist air AA may disappear.

By regulating the elevation angle φ of the upward slope 8 provided in the bottom surface of the combustible waste flow channel 3 regardless of the introduction of the assist air AA, it is also possible to regulate an angle of ejection of the combustible waste flow ejected from the combustible waste flow channel 3. It is possible to continue the floating state of the combustible waste RF within the cement kiln for a long period of time since the angle of ejection of the combustible waste flow is appropriately regulated.

Taking into consideration the circumstances mentioned above, the angle (the elevation angle φ) of the upward slope 8 is preferably in a range between 1 degree and 4 degrees. In the case where the elevation angle φ of the upward slope 8 is less than 1 degree, it is necessary to execute an action of making the combustible waste flow upward only by the assist air AA, and an energy amount required for blowing the assist air AA is excessively required. Further, in the case where the elevation angle φ of the upward slope 8 is greater than 4 degrees, the diffusion effect by the assist air AA is added, so that there is a risk that the combustible waste RF may partly come into collision with the upper inner wall of the cement kiln.

Further, the rate in the vertical direction of the flow rate of the assist air AA is important because it is possible to vertically regulate the ejecting direction of the combustible waste RF by regulating the rate between the downward assist air flow rate and the upward assist air flow rate, thereby changing the direction of the combustible waste RF ejected from the combustible waste injection device 2 further vertically upward. As a result, it is possible to regulate the floating state of the combustible waste RF ejected in the good diffusion state by the assist air AA to a further preferable state.

Taking into consideration the circumstances mentioned above, it is preferable to set the rate r of the downward assist air flow rate flowed into from the vertically upper side of the horizontal plane including the axis center in relation to the upward assist air flow rate flowed into from the vertically lower side of the horizontal plane including the axis center to a range between 0.5 and 1.0. In the case where the rate r is less than 0.5, the combustible waste flow blows up from the lower side greatly, and the combustible waste RF may partly come into collision with the upper inner wall of the cement kiln. Further, in the case where the rate r is greater than 1.0, that is, in the case where the downward assist air flow rate is greater than the upward assist air flow rate, a downward force is applied to the combustible waste flow and may generate a great disturbance in the combustion waste flow in combination with the upward effect by the upward slope.

As mentioned above, according to the present invention, it is possible to optimize the condition for operating the combustible waste injection device 2 so as to stabilize the flame state of the cement kiln burner by setting the elevation angle φ of the upward slope 8, the position of the assist air inflow port 5 and the inflow angle θ within the range shown by Table 1 before the operation of the combustible waste injection device 2, and further regulating the assist air flow rate V, and the rate r of the assist air flow rate from the vertical direction by means of the blowing fan and/or the flow rate regulating valve when the combustible waste injection device 2 is operated. In the case of the combustible waste injection device 2 according to the aspect shown in FIG. 6 which is provided with neither the assist air flow channel 4 nor the assist air inflow port 5, the flame state of the cement kiln burner can be stabilized by regulating the elevation angle φ of the upward slope 8.

Next, a description will be given of a combustion simulation about a rate (a kiln inside falling rate) that the combustible waste RF (here, non-rigid plastic) performs landing combustion in the case where each of the items in Table 1 is changed.

In particular, the case where each of the items in Table 1 is changed was investigated according to simulation (software: FLUENT produced by ANSYS JAPAN K. K.) in the case where the specification and the condition for operating of the cement kiln burner device 1 mentioned above are fixed. A set value of each of the items in the simulation is shown in Table 2. As a current example (comparative example) which is not provided with the upward slope 8 and does not use the assist air AA, an amount of combustible waste RF which was processed was set to two levels (5 t/hour and 2 t/hour).

Figure 8:
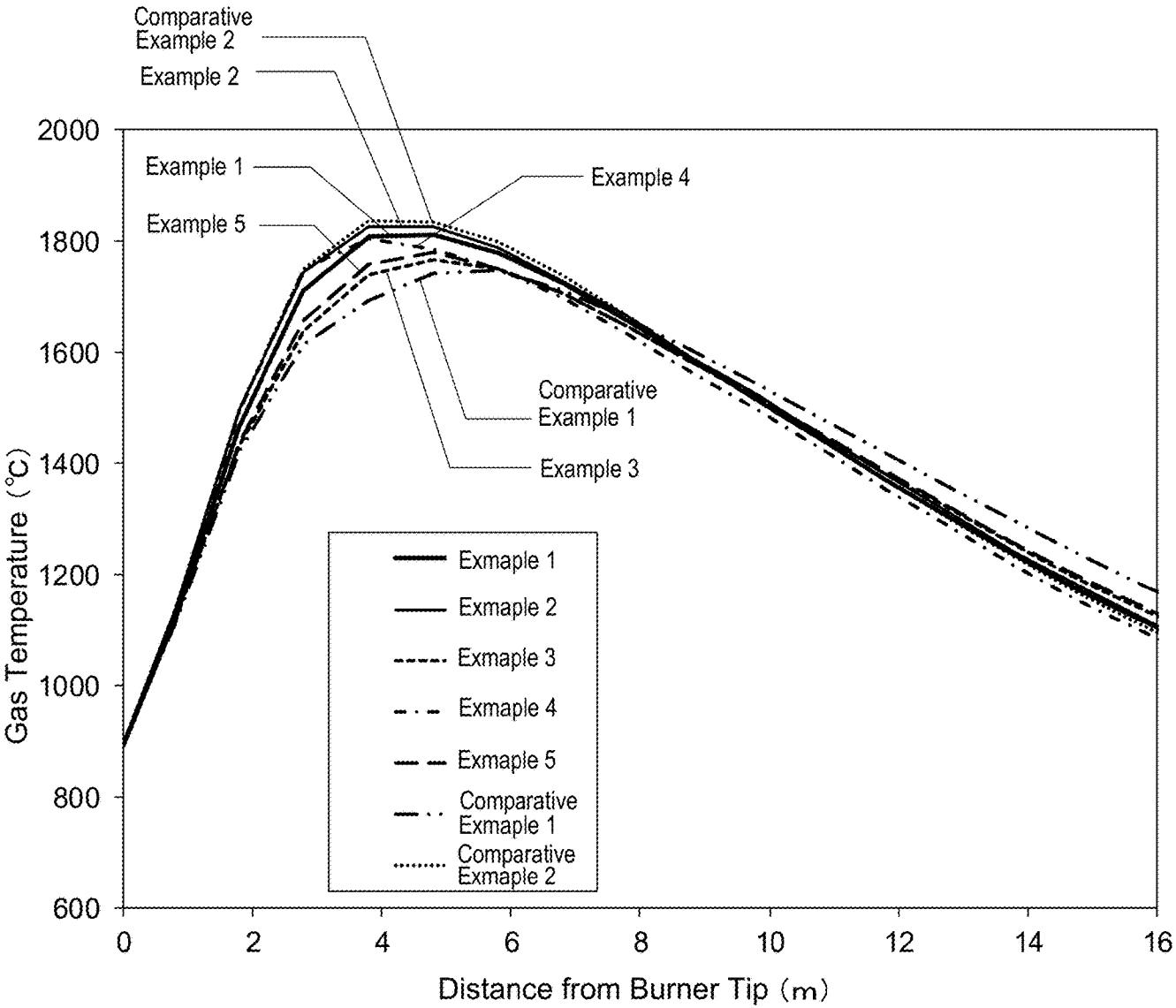
FIG. 8 is a graph showing a result of simulation according to a gas temperature distribution within cement kilns according to Examples 1 to 5 and Comparative Examples 1 to 2 in the case where a waste plastic having a diameter of 30 mm is used as a supplemental fuel at a fixed amount with respect to a main fuel (a pulverized coal) under a condition for operating shown in Table 2, with the combustible waste injection device shown in FIG. 7.

A kiln inside falling rate of the combustible waste RF (non-rigid plastic having a diameter of 30 mm and a thickness of 0.5 mm) obtained as a result of the simulation is shown in Table 3, and gas temperature distributions within the kiln of Examples 1 to 5 and Comparative Examples 1 to 2 are shown in FIG. 8.

TABLE 3-continued

| | Kiln inside falling rate of combustible waste RF (mass %) |
|---|---|
| Example 4 | 0.6 |
| Example 5 | 0.0 |
| Comparative Example 1 | 3.0 |
| Comparative Example 2 | 0.5 |

According to the results in Table 3, it is confirmed that the kiln inside falling rate of the combustible waste RF can be sufficiently lowered in the level of each of Examples 1 to 5 in comparison with the level of Comparative Example 1 in which the condition for the amount of the combustible waste RF which was processed is in common with 5 t/hour. More specifically, the kiln inside falling rate can be lowered in comparison with Comparative Example 1 corresponding to the current condition for operating even in Example 1 which does not utilize the assist air AA, and the effect of suppressing the landing combustion of the combustible waste RF can be therefore confirmed by the provision of the upward slope 8. Further, according to Examples 2 to 5 introducing the assist air AA in addition to the upward slope 8, the kiln inside falling rate is further lowered in comparison with Example 1.

According to Examples 3 to 5, the value of the kiln inside falling rate can be lowered to one third or less in comparison with Comparative Example 1. In particular, according to Example 5, the kiln inside falling rate 0% is achieved. As a result, according to the combustible waste injection device and the method for operating the combustible waste injection device of the present invention, it is confirmed that the combustible waste RF can be effectively burnt.

Further, in the temperature distribution of the gas within the cement kiln shown in FIG. 8, the temperature distribution of the gas in each of Examples 1 to 5 is substantially identical to that of the case of Comparative Example 2 where the amount of the combustible waste RF which was processed is set to 2 t/hour under the current condition for operating. The condition for operating of Comparative Example 2 is obtained by setting the supply amount of the combustible waste RF less than each of the examples, in which the kiln inside falling rate of the combustible waste RF is 0.5 mass %, corresponding to a good kiln burner combustion state. On the other hand, in Comparative Example 1 having the same amount of the combustible waste RF which was processed as the present Example (5

TABLE 2

| | elevation angle φ of upward slope 8 (°) | Assist air flow rate((assist air flow rate)/(primary air amount flowing through combustible waste flow channel 3))(vol %) | Rate r of assist air flow rate in vertical direction (downward assist air flow rate)/(upward assist air flow rate) | Position of assist air flow inlet 5 (distance from end portion) (mm) | Inflow angle θ of assist air AA (°) |
|---|---|---|---|---|---|
| Example 1 | 2 | — (Without assist air) | — (Without assist air) | — (Without assist air) | — (Without assist air) |
| Example 2 | 2 | 25 | 0.80 | 50 | 90 |
| Example 3 | 2 | 25 | 0.67 | 50 | 90 |
| Example 4 | 4 | 25 | 0.80 | 50 | 90 |
| Example 5 | 2 | 50 | 0.80 | 50 | 90 |
| Comparative Example 1 (RF: 5 t/hour) | — (Without upward slope) | — (Without assist air) | — (Without assist air) | — (Without assist air) | — (Without assist air) |
| Comparative Example 2 (RF: 2 t/hour) | — (Without upward slope) | — (Without assist air) | — (Without assist air) | — (Without assist air) | — (Without assis tair) |

TABLE 3

| | Kiln inside falling rate of combustible waste RF (mass %) |
|---|---|
| Example 1 | 2.1 |
| Example 2 | 1.4 |
| Example 3 | 0.8 |

t/hour) under the current condition for operating, a lot of combustible wastes RF perform land combustion, that is, the kiln inside falling rate of the combustible waste RF is 3.0 mass %, as well as the temperature of the gas within the cement kiln is greatly lowered. More specifically, according to the present invention, it is confirmed that the combustible waste RF can be utilized as the supplemental fuel without greatly changing the temperature distribution of the gas within the cement kiln.

In other words, according to the present invention, it can be understood that the combustible waste can be utilized as the supplemental fuel while keeping an optimum combustion state of the cement kiln burner.

The installing number and the installing place of the assist air inflow port provided in the combustible waste injection device are not limited to the structures of the embodiments mentioned above.

DESCRIPTION OF REFERENCE SIGNS

1 cement kiln burner device
2 combustible waste injection device
3 combustible waste flow channel
3*c* axis center of combustible waste flow channel
4 assist air flow channel
4-1, 4-2 assist air flow channel
4-3, 4-4, 4-5, 4-6, 4-7, 4-8 assist air flow channel
5 assist air inflow port
5-1, 5-2, 5-3, 5-4, 5-5, 5-6, 5-7, 5-8, 5-9, 5-10 assist air inflow port
5-11, 5-12, 5-13, 5-14, 5-15, 5-16 assist air inflow port
6 partition member
7 assist air delivery tool
8 upward slope
11 air pipe
12 combustible waste transfer pipe
13 air pipe
21 powdered-solid-fuel flow channel
22 air flow channel (first air flow channel)
22*a* swirl vane
31 oil flow channel
113, 114, 118 branched pipe
135, 136, 137 branched pipe
AA assist air
B113, B114, B135, B136, B137, B118 flow rate regulating valve
F1, F2, F3 blowing fan
RF combustible waste
θ inflow angle of assist air
φ elevation angle of upward slope

What is claimed is:

1. A combustible waste injection device which can be attached to a cement kiln burner device having at least one air flow channel in an inner side of a powdered-solid-fuel flow channel, the combustible waste injection device comprising:

a combustible waste flow channel which is arranged in an inner side of the air flow channel in an innermost shell, is installed in parallel to an axial direction of the cement kiln burner device and is provided for feeding a combustible waste flow, wherein the combustible waste flow channel has an inclined surface formed near the injection port, the inclined surface having a rising slope toward the injection port in such a manner that a combustible waste flow channel width in a vertical direction is narrowed toward the injection port with a combustible waste flow channel width in a horizontal direction being maintained.

2. The combustible waste injection device according to claim 1, wherein the inclined surface is positioned at a position where an opposite end portion to the injection port of the combustible waste flow channel in the axial direction is between 150 mm and 2000 mm away from the injection port, and an elevation angle thereof is between 1 degree and 4 degrees.

3. The combustible waste injection device according to claim 1, further comprising an assist air inflow port which can flow an assist air flow into the combustible waste flow channel toward the axis center of the combustible waste flow channel at a position where the inclined surface is formed in the combustible waste flow channel, wherein the assist air inflow port is arranged at a plurality of positions in a circumferential direction.

4. The combustible waste injection device according to claim 3, wherein the assist air inflow port is arranged at a plurality of positions sandwiching in a vertical direction a horizontal plane including the axis center of the combustible waste flow channel when cutting with a plane orthogonal to the axis center of the combustible waste flow channel.

5. The combustible waste injection device according to claim 4, wherein the combustible waste flow channel is adapted to be capable of ejecting the combustible waste flow upward in the vertical direction after a width of the combustible waste flow is reduced in the direction toward the axis center by the assist air flow flowing into the combustible waste flow channel from the assist air inflow port.

6. The combustible waste injection device according to claim 3, wherein the assist air inflow port is installed in a range between 10 mm and 600 mm from the injection port of the combustible waste flow channel.

7. A method for operating the combustible waste injection device according to claim 1, wherein the method comprises ejecting the combustible waste flow from the combustible waste flow channel vertically upward from the horizontal plane.

8. The method for operating the combustible waste injection device according to claim 7, further comprising an assist air inflow port which can flow an assist air flow into the combustible waste flow channel toward the axis center of the combustible waste flow channel at a position where the inclined surface is formed in the combustible waste flow channel, wherein the assist air inflow port is arranged at a plurality of positions in a circumferential direction, and wherein an upward assist air flow rate flowed into the combustible waste flow channel from the vertically lower side of the horizontal plane is equal to or more than a downward assist air flow rate flowed into the combustible waste flow channel from the vertically upper side of the horizontal plane.

9. The method for operating the combustible waste injection device according to claim 8, wherein a total amount of the air flow rates flowed into the combustible waste flow channel from the assist air inflow port is between 5 volume % to 65 volume % of a primary air flow rate flowing in the combustible waste flow channel.

10. The method for operating the combustible waste injection device according to claim 8, wherein a rate of the downward assist air flow rate with respect to the upward assist air flow rate is between 0.5 and 1.0.

11. The method for operating the combustible waste injection device according to claim 8, wherein an inflow angle of the assist air flow flowed into the combustible waste flow channel is greater than 0 degrees and equal to or less than 90 degrees with respect to the flow feeding direction of the combustible waste flow which flow feeds within the combustible waste flow channel.

* * * * *